US006222110B1

(12) United States Patent
Curtis et al.

(10) Patent No.: US 6,222,110 B1
(45) Date of Patent: Apr. 24, 2001

(54) SIMULATED TONE STACK FOR ELECTRIC GUITAR

(75) Inventors: Dale Vernon Curtis; Keith Lance Chapman, both of Scottsdale; Charles Clifford Adams, Gilbert, all of AZ (US)

(73) Assignee: Fender Musical Instruments Corp., Scottsdale, AZ (US)

( * ) Notice: Subject to any disclaimer, the term of this patent is extended or adjusted under 35 U.S.C. 154(b) by 0 days.

(21) Appl. No.: 09/595,273

(22) Filed: Jun. 15, 2000

(51) Int. Cl.[7] ..... G10H 1/12; G10H 1/06

(52) U.S. Cl. ..... 84/736; 84/735; 84/DIG. 9

(58) Field of Search ..... 84/692–702, 735–738, 84/723–726, 730–731, DIG. 9, DIG. 24; 330/149–152

(56) References Cited

U.S. PATENT DOCUMENTS 4,117,413 * 9/1978 Moog ..... 330/151
5,133,014 * 7/1992 Pritchard ..... 84/735
5,268,527 * 12/1993 Waller, Jr. ..... 84/736
5,731,536 * 3/1998 Kelsey ..... 84/736

* cited by examiner

*Primary Examiner*—Robert E. Nappi
*Assistant Examiner*—Marlon Fletcher
(74) *Attorney, Agent, or Firm*—Paul F. Wille

(57) ABSTRACT

A combination of limited data, 3D linear interpolation, and a unique simulation circuit are combined to provide a programmable tone control that can simulate any desired tone stack. In accordance with one aspect of the invention, it has been found that a reduced number of data points plus interpolation provides sufficiently accurate coefficients for simulation. The data points are obtained from measurements of the actual operation of the analog tone stacks to be simulated. A second aspect of the invention is the simulation circuit controlled by the coefficients to accurately reproduce the operation of any given tone stack. The simulation circuit uses two programmable filters and three variable gain amplifiers to simulate a tone stack. The cut-off frequency of each filter and the gain of each amplifier are determined by coefficients extracted by interpolation from stored data.

18 Claims, 4 Drawing Sheets

| Knob Position | Bass Gain | Mid Gain | Treble Gain | (Hz) | (Hz) |
|---|---|---|---|---|---|
| L,M,H | $K_1$ | $K_2$ | $K_3$ | $f_1$ | $f_2$ |
| 0,0,0 | 0.33 | 0.110 | 0 | 700 | 2800 |
| 0,0,1 | 0.33 | 0.100 | 0.490 | 700 | 2800 |
| 0,0,2 | 0.34 | 0.100 | 1.000 | 700 | 2800 |
| 0,0,3 | 0.35 | 0.100 | 1.500 | 700 | 2800 |
| 0,0,4 | 0.35 | 0.100 | 1.990 | 700 | 2800 |
| 0,1,0 | 0.19 | 0.385 | 0.185 | 85 | 980 |
| 0,1,1 | 0.39 | 0.270 | 0.620 | 750 | 2700 |
| . | . | . | . | . | . |
| . | . | . | . | . | . |
| . | . | . | . | . | . |
| 0,4,4 | 0.50 | 0.650 | 1.890 | 800 | 2800 |
| 1,0,1 | 0.53 | 0.085 | 0.480 | 450 | 2600 |
| 1,0,2 | 0.55 | 0.070 | 0.980 | 440 | 2600 |
| . | . | . | . | . | . |
| . | . | . | . | . | . |
| . | . | . | . | . | . |
| 4,4,0 | 1.60 | 0.570 | 0.580 | 100 | 2350 |
| 4,4,1 | 1.60 | 0.556 | 0.890 | 100 | 2350 |
| 4,4,2 | 1.55 | 0.545 | 1.200 | 110 | 2350 |
| 4,4,3 | 1.55 | 0.535 | 1.550 | 110 | 2400 |
| 4,4,4 | 1.55 | 0.525 | 1.850 | 110 | 2400 |

FIG. 6

SIMULATED TONE STACK FOR ELECTRIC GUITAR

BACKGROUND OF THE INVENTION

This invention relates to an amplifier for an electric guitar and, in particular, to a simulated tone stack in such an amplifier.

An electric guitar can have either a solid body or a hollow body, the latter generally being referred to as an electro-acoustic guitar. Both types of guitars include a transducer for converting the vibration of the strings to an electrical signal. The transducer in an electro-acoustic guitar is typically a piezoelectric element coupled to the strings at the junction of the strings with the body of the guitar. In a guitar with a solid body, the transducer is typically magnetic and is located near the junction of the strings with the body of the guitar. The invention can be used with either type of guitar, although the following description is primarily in terms of a guitar having a solid body.

An amplifier for an electric guitar has low fidelity and the low fidelity contributes to the "voice" of the guitar to such an extent that the guitar and the amplifier together are the instrument, not the guitar alone. The unique sound or voice associated with particular electric guitars comes from several sources including a tone control circuit, overdriven amplifier stages, other voice equalization stages, and the audio characteristics of the speaker element and the enclosure. Many patents, such as U.S. Pat. No. 5,789,689 (Doidic et al.) and U.S. Pat. No. 5,977,474 (O'Brien), are concerned with simulating an overdriven tube type amplifier in a transistorized amplifier. This invention concerns a tone control circuit, not an imitation tube circuit or circuits for producing various effects.

A tone control circuit, sometimes referred to as a tone stack, for a guitar amplifier is typically a variation on a circuit such as shown in FIGS. 1–4. The O'Brien patent discloses one such tone control circuit. Slight rewiring and, more often, changes in component values produce distinct voices for each circuit. There are many variations of the circuit in existence. If a performer wants a particular sound, he must obtain the amplifier that has the tone stack for that sound. Amplifiers with more than one tone stack are not made, partly because most manufacturers are striving for a unique sound. On the other hand, providing several complete sound systems for a concert with several performers is costly and inconvenient.

Simulating several tone stacks with a single programmable amplifier is difficult for several reasons. A first reason is that portions of the tone stack interact; that is, the bass, mid-range, and treble controls are not isolated elements. A second reason is the number of combinations obtainable from relatively few elements. Specifically, reproducing the response curves for each tone control circuit at each possible setting of bass, mid-range, and treble involves millions of combinations of parameters. A third reason is that each tone stack has its own set of parameters, further increasing the amount of data.

It is known in the filter art to create a desired frequency response by coupling a signal directly to the non-inverting input of an amplifier and coupling a filtered signal to the inverting input of the amplifier; see *Electronic Filter Design Handbook* by Williams and Taylor, Third Edition, McGraw-Hill, Inc., 1995, pages 6.30–6.31. As disclosed in the text, a filtered signal is inverted and subtracted from the unfiltered signal to produce the desired response.

Interpolation, in mathematics and as implemented in a computer, is known in the art. In its simplest, one dimensional form, interpolation is approximating an unknown value between two known values. For example, children are taught to estimate by comparing results. If $5^2=25$ and $6^2=36$, then one might reasonably estimate that $(5.5)^2 \approx 30.5$, which is half-way between 25 and 36 and is not a bad estimate for the actual value (30.25). A far more elegant treatment of the subject is provided in §3.6 "Interpolation in Two or More Dimensions" Numerical Recipes in C, Cambridge University Press 1992.

In view of the foregoing, it is therefore an object of the invention to provide a circuit for simulating many tone stacks in a single amplifier for an electric guitar.

Another object of the invention is to provide a circuit that can simulate each of a plurality of tone stacks and that is compatible with circuits for producing linear and non-linear effects in an audio amplifier.

A further object of the invention is to provide a programmable tone control circuit.

SUMMARY OF THE INVENTION

The foregoing objects are achieved in this invention in which a combination of limited data, 3D linear interpolation, and a set of programmable filters are combined to provide a programmable tone control that can simulate any desired analog tone stack. In accordance with one aspect of the invention, it has been found that a reduced number of data points plus interpolation provides sufficiently accurate coefficients for simulation. The data points are obtained from measurements of the actual operation of the analog tone stacks to be simulated. A second aspect of the invention is the simulation circuit controlled by the coefficients to accurately reproduce the operation of any given tone stack. The simulation circuit uses two programmable filters and three variable gain amplifiers to simulate a tone stack. The cut-off frequency of each filter and the gain of each amplifier are determined by coefficients extracted by interpolation from stored data.

BRIEF DESCRIPTION OF THE DRAWINGS

A more complete understanding of the invention can be obtained by considering the following detailed description in conjunction with the accompanying drawings, in which:

FIG. 6 is a partial table of the coefficients produced in accordance with the invention;

DETAILED DESCRIPTION OF THE INVENTION

Figure 1:
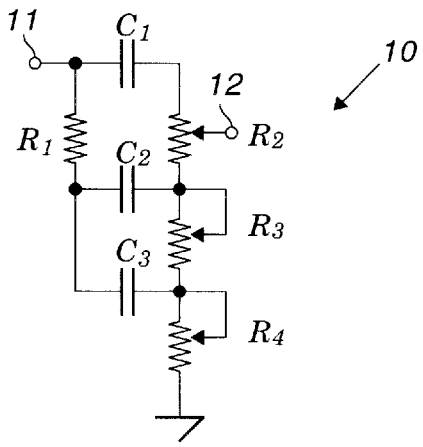
FIG. 1 (PRIOR ART)
FIG. 1 is a schematic diagram of a known tone control circuit for electric guitars.

FIG. 1 is a schematic of a tone stack that has been used for years in amplifiers such as the "Twin" amplifier, sold by Fender Musical Instruments since the 1950's. The circuit continues to be used in different forms, i.e. with different values for the components, each with its own voice. The same circuit is shown in the O'Brien patent, identified above.

Tone stack 10 includes input terminal 11 and output terminal 12. Resistors $R_2$, $R_3$, and $R_4$ are connected in series and the series is coupled to input terminal 11 by capacitor $C_1$. Resistor $R_1$ is coupled between input terminal 11 and capacitors $C_2$ and $C_3$ The frequency response of the tone stack generally has a broad bass peak and a broad treble peak separated by a mid-range valley. Obviously, the specific settings of the tone controls modify the frequency response. Resistor $R_1$ is known as the "slope" resistor. As the resistance of $R_1$ is reduced, the bass peak and mid-range valley increase in frequency and while the treble peak increases in amplitude.

Capacitor $C_1$ is the treble capacitor. Decreasing the capacitance of this capacitor decreases the amplitude but increases the frequency of the treble peak and the mid-range valley. Capacitor $C_2$ is the bass capacitor. Decreasing the capacitance of this capacitor decreases the amplitude but increases the frequency of the bass peak. The mid-range valley increases in amplitude. Capacitor $C_3$ is the mid-range capacitor. Decreasing the capacitance of this capacitor increases the frequency of the bass peak and fills the mid-range valley.

Potentiometer $R_2$ is the treble resistor. Moving the tap away from $C_1$ increases the amplitude of the bass peak, increases the depth of the mid-range valley, and decreases the amplitude of the treble peak. The mid-range valley moves up in frequency. Potentiometer $R_3$ is the bass resistor. Decreasing the resistance of this potentiometer decreases the amplitude of the bass peak and increases the amplitude of the mid-range valley. Potentiometer $R_4$ is the midrange resistor. Decreasing the resistance of this potentiometer decreases the amplitude of the bass and treble peaks slightly and greatly increases the depth of the mid-range valley and shifts the valley to a lower frequency.

Figure 3:
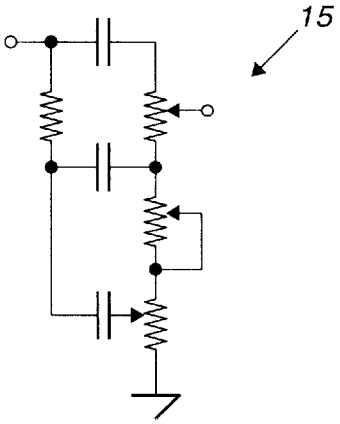
FIG. 3 (PRIOR ART)
FIG. 3 is a schematic diagram of another known tone control circuit.
Figure 4:
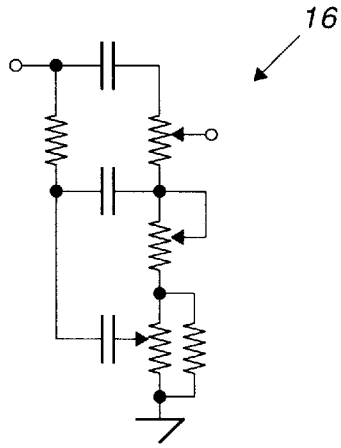
FIG. 4 (PRIOR ART)
FIG. 4 is a schematic diagram of another known tone control circuit.

Thus, the components in a tone stack are highly interactive. Changing the value of a single component significantly changes the frequency response of the circuit, making simulation difficult. The same consideration applies to tone stack 14 (FIG. 2), tone stack 15 (FIG. 3), and tone stack 16 (FIG. 4), which are representative of but not exhaustive of the variations on the original tone stack circuit.

Figure 5:
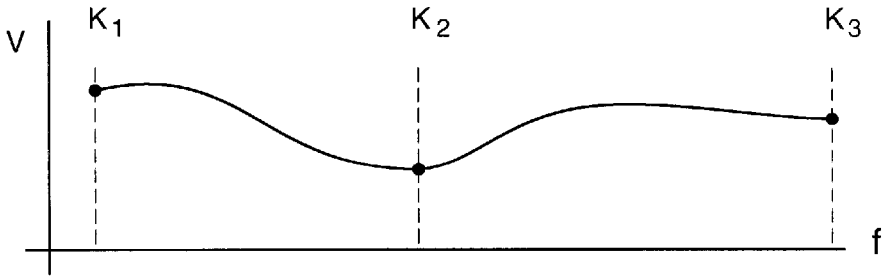
FIG. 5 is a chart showing the frequency response of a tone control circuit for a single setting of the tone controls.
Figure 8:
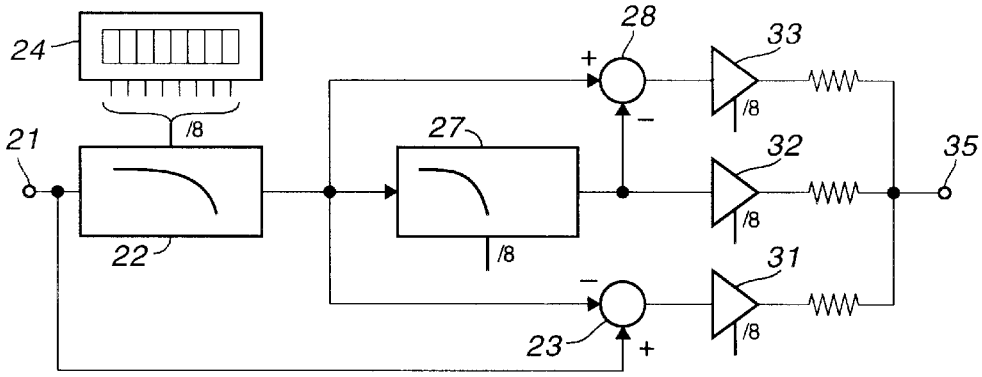
FIG. 8 is a block diagram of a tone control circuit constructed in accordance with a preferred embodiment of the invention.

FIG. 5 is a chart showing the frequency response of a tone stack. The tone stack is simulated with a programmable filter, a preferred embodiment of which is shown in FIG. 8 The data for controlling the preferred filter includes two crossover frequencies ($f_1$, $f_2$) and three gain control settings ($K_1$, $K_2$, $K_3$), for a total of five parameters. Other programmable filters, such as an equalizer, have a bandpass center frequency and a gain control for each band. Whatever the type of filter, the parameters are obtained by matching the frequency response of the programmable filter to the frequency response of the tone stack under test by changing parameters of the programmable filter until a match is obtained. The parameters are then read and stored as coefficients defining a curve such as illustrated in FIG. 5.

"Matching" the response curve of the stack does not mean that the response curves are identical. The curves are superimposed on a display and the closest match obtained. There are several reasons why the response curves may not be identical. Primarily, there is no such thing as a perfect match just as there is no such thing as a perfect circle. Another reason is that the tone controls vary continuously whereas the data to the programmable filters varies in discrete steps. The curves are matched in the sense that one with the aural acuity of a professional musician cannot distinguish the two frequency responses.

The measurements are taken for selected settings of each tone control (bass, mid-range, and treble). In one embodiment of the invention, the settings were 1, 3.5, 6, 8.5, and 10 on the traditional knobs for the tone controls (labeled 1 to 10 in a 270° arc). The result is six hundred twenty-five coefficients for each tone stack (five bass settings times five mid-range settings times five treble settings times five parameters).

Figure 2:
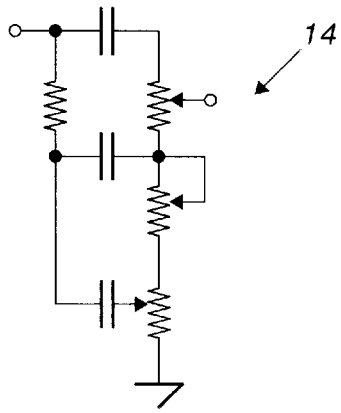
FIG. 2 (PRIOR ART)
FIG. 2 is a schematic diagram of another known tone control circuit.

FIG. 6 is a partial table of the parameters for simulating a common tone stack (FIG. 2). Knob position is indicated as 0–4, with 0 being fully counterclockwise and 4 being fully clockwise. The number 2 represents turning half-way between 0 and 4. The number 1 represents turning half-way between 0 and 2. The number 3 represents turning half-way between 2 and 4. For each of the one hundred twenty-five combinations of positions for the three knobs, the five parameters were measured, as indicated, for a total of six hundred twenty-five parameters. Gain is expressed as a unitless decimal number, not in decibels.

For digital implementations of the invention, the data, in units of frequency are converted into non-dimensional coefficients in accordance with the is following equation.

$$c=1-e^{-2\pi(f/f_s)}$$

In the above equation, c is the coefficient, f is the cross-over frequency, and $f_s$ is the sampling frequency. The data is then converted or normalized into a one byte (eight bit) character having a value from 0 to 255. This step provides unsigned data for interpolation, simplifies processing the data, and was required because the invention was first implemented with an eight bit microprocessor. Microprocessors with larger "words", e.g. sixteen, twenty-four, or thirty-two bits, may not need the data converted or may require other conversions.

The input values for the desired tone are determined from user settings of potentiometers. In other words, the invention is "transparent" to the user, for whom the controls appear the same as for amplifiers of the prior art. The setting of each tone control is sampled, digitized, and stored as a single byte in memory. The data from the tone control settings are then used to interpolate the coefficients for the desired type of tone stack.

Figure 7:
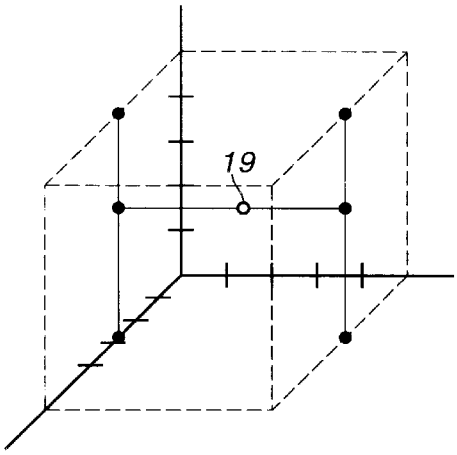
FIG. 7 is illustrates the interpolation operation used in the invention.

3D linear interpolation is then performed five times, once for each of the measured coefficients. FIG. 7 illustrates the interpolation for one coefficient from the tone control settings. In order to simulate point 19, the x, y, and z coordinates of point 19 must be interpolated from the existing data. Obviously, if a coordinate corresponds exactly to one setting of tone controls, e.g. 3.5, then no interpolation is necessary and the data is used directly as a coefficient. The interpolations result in five interdependent values to be passed to the simulation circuit.

The tone control settings (bass, mid-range, and treble) each have a value of 0–255. This value is used to interpolate the coefficients to produce the five values that are passed to the simulation circuit, thereby configuring the circuit as though it were a particular tone stack with particular settings on the tone controls. FIG. 7 illustrates the interpolation along three axes, bass, mid-range, and treble for one coefficient. After interpolation, the coefficients are truncated to a single byte and the five bytes are stored in memory for future use or are passed directly to the simulation circuit.

FIG. 8 is a schematic of a simulation circuit constructed in accordance with the invention. The circuit includes input 21 coupled to filter 22 and to non-inverting input of circuit 23. The output from filter 22 is coupled to an inverting input of circuit 23. Filter 22 acts is a low pass filter having a cut-off frequency that eliminates treble signals. The cut-off frequency is determined by the data stored in register 24, which can be part of a microprocessor, a separate memory device, or a register in a separate I/O device.

The output signals from circuit 23 are treble signals because the lower frequency signals are subtracted from the unfiltered signal. The treble signals are coupled through variable gain amplifier 31 to a summation network, represented by three resistors, coupled to output 35. One of the interpolated coefficients is stored in register 24 and a second interpolated coefficient controls the gain of amplifier 31. The data is coupled over a suitable data bus, represented in FIG. 8 by the "/8" notation.

The output from filter 22 includes mid-range and bass signals that are coupled to filter 27 and to the non-inverting input of circuit 28. The cut-off frequency of filter 27 is lower than the cut-off frequency of filter 22. Thus, filter 27 passes bass signals to variable gain amplifier 32. The output of amplifier 32 is coupled by the summation network to output 35. The third coefficient controls the cut-off frequency of filter 27 and the fourth coefficient controls the gain of amplifier 32.

Circuit 28 subtracts the bass signals from the bass and mid-range signals, leaving only the mid-range signals to be coupled to variable gain amplifier 33. The output of amplifier 33 is coupled by the summation network to output 35. The fifth coefficient controls the gain of amplifier 33. The cut-off frequencies of filters 22 and 27 are not abrupt and corresponds to a signal reduction of 3 dB (fifty percent). Because of this and the construction of the circuit, there is ample interaction among the three bands of signals, just as in a tone stack. Tests of several embodiments of the invention have produced frequency response curves substantially identical to the response curves of the intended tone stacks. The faithfulness of the simulation was also confirmed by subjective listening tests.

Figure 9:
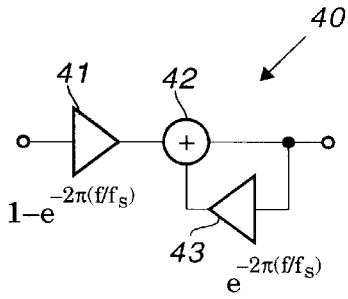
FIG. 9 is a schematic diagram of the filters used in FIG. 7.

FIG. 9 is a schematic of the circuit used for filters 22 and 27. Filter 40 includes amplifier 41 coupled to one input of summation circuit 42 and a feedback amplifier having an input coupled to the output of the summation circuit and an output coupled to an input of the summation circuit. The transfer function of amplifier 41 is given above as the definition of the coefficient c. The transfer function of amplifier 43 is (1−c).

Figure 10:
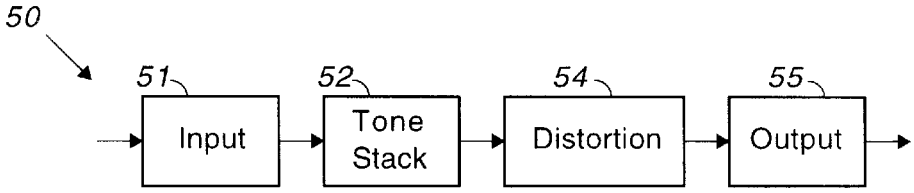
FIG. 10 is a block diagram of a preferred embodiment of an amplifier for an electric guitar.

FIG. 10 is a block diagram of an amplifier for an electric guitar constructed in accordance with a preferred embodiment of the invention. Amplifier So includes analog input 51, which includes a preamplifier and impedance matching circuitry, and tone stack simulation circuit 52, which is implemented as a DSP integrated circuit coupled by a data bus, not shown, to a microprocessor, not shown. The microprocessor also includes suitable A/D (analog to digital) conversion circuitry for converting the settings of the tone controls to digital data for interpolation. The invention relates to the combination, not to the details of conversion or interpolation, which are known in themselves.

Figure 11:
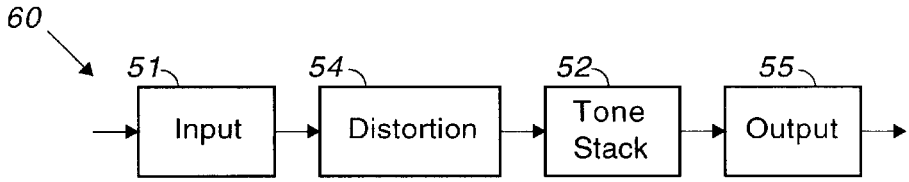
FIG. 11 is a block diagram of an alternative embodiment of an amplifier for an electric guitar.

The output of tone stack simulation circuit 52 is coupled to distortion circuit 54. The prior art is replete with examples of distortion circuits, including tube emulating circuits and circuits for producing various effects, such as fuzz, etc. The output from circuit 54 is coupled to a suitable power amplifier in output 55. In FIG. 11, amplifier 60 includes the same elements, except that the position of tone stack simulation circuit 52 and distortion circuit 54 are reversed. Switching these two portions of the circuit changes the sound produced even if the control settings are identical. Either way, the tone stack simulation circuit of the invention is compatible with the distortion circuit. Constructed as illustrated in FIG. 10, an amplifier for an electric guitar produces the classic voices of the various existing tone stacks. As new voices are generated, it may be necessary to use the configuration of FIG. 11 to simulate a voice.

Figure 12:
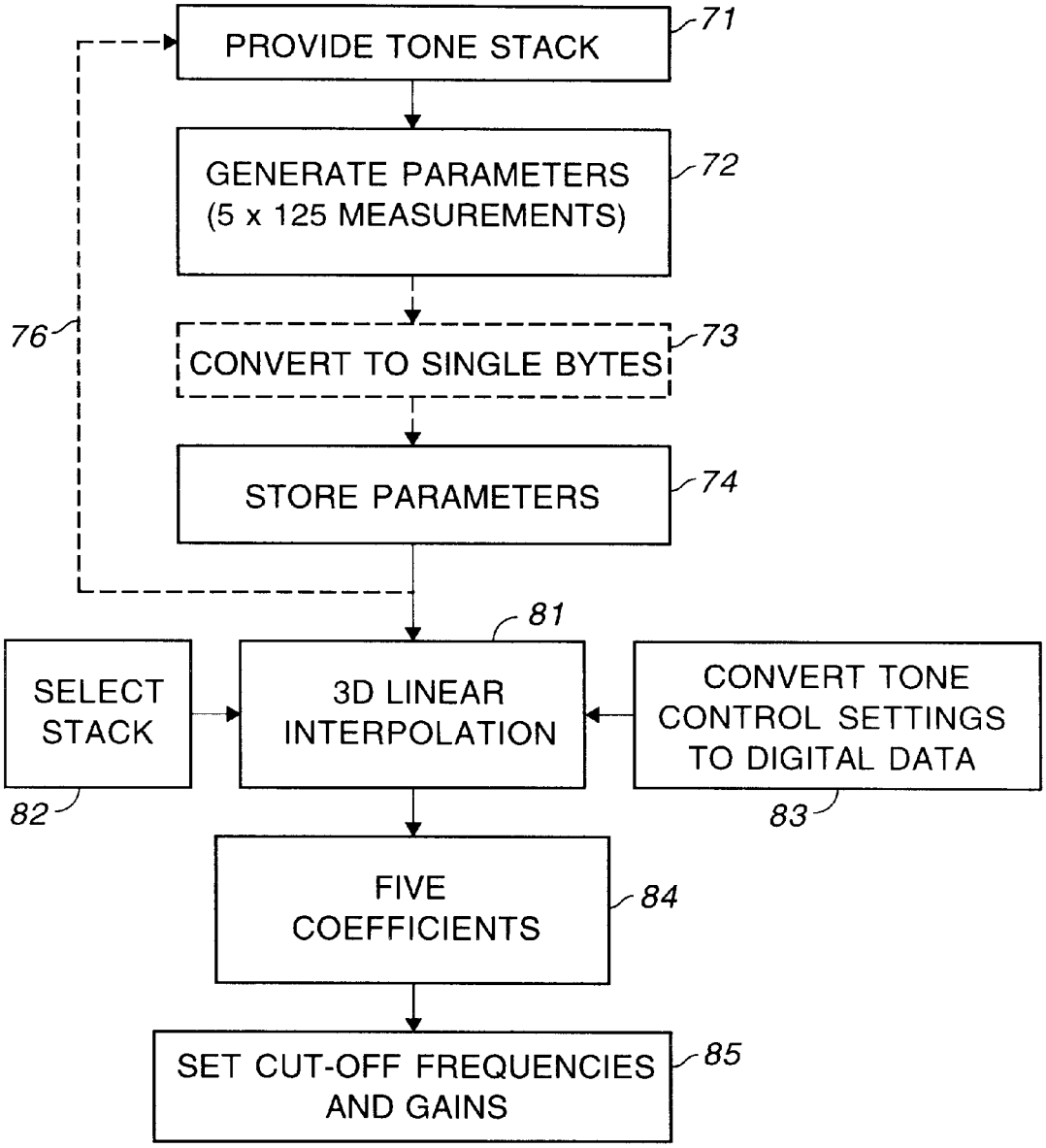
FIG. 12 is a flow chart for generating the coefficients used in a tone control circuit constructed in accordance with the invention.

FIG. 12 is a flow chart illustrating the generation and use of data for simulating various tone stacks. Data is obtained by constructing or simulating the actual stack and then measuring the gain and cut-off frequencies of a programmable filter at the various setting of the tone controls. This is represented in the flow chart as blocks 71 and 72. The data is then converted into a plurality of bytes (625 bytes per tone stack) and stored in computer memory. As previously noted, step 73 is optional and depends upon the number of bits in a word in the particular microprocessor used. As indicated by dashed line 76, this process is repeated for the number of stacks to simulate. Once the data is stored, blocks 71–74 are no longer needed.

In an amplifier incorporating the invention, the usual tone controls are provided and, in addition, some sort of input is provided for identifying the tone stack to be simulated. If only a few are stored in memory, then a rotary switch can be used for selection. If many tone stacks are in memory, then some other form of input can be used to select the tone stack being simulated.

Block 81 represents a number of steps internal to the digital control portion of an amplifier incorporating the invention. After the stack is identified, the corresponding interpolation data is read, and a digital representation of the tone control settings is read (block 83). The data is interpolated to produce five coefficients, as represented by block 84. The five coefficients are applied to the DSP chip and the amplifier is now ready to operate, simulating the designated tone stack. The simulation is updated periodically at a rate determined by the internal clock of the computer or on an interrupt basis when an external control is changed. Either way, modern DSP chips can be reconfigured in a small fraction of a second, much less than the time it would take to reach for a control, make a change, and move away again.

The invention thus provides a programmable tone control circuit that can simulate each of a plurality of tone stacks within a single amplifier for an electric guitar. The circuit is compatible with circuits for producing linear and non-linear effects in an audio amplifier. The circuit enables one to have a single amplifier that can emulate any voice desired, which greatly reduces the amount of equipment that must be set up on stage and trucked from show to show.

Having thus described the invention, it will be apparent to those of skill in the art that various modifications can be made within the scope of the invention. For example, although described in terms of five positions of the tone controls, the invention can be implemented with measurements taken at more than five positions. Fewer than five positions may be acceptable for simulating some tones stacks but not for others, depending upon the nature of the response curves and the amount of change from setting to setting. The invention is conveniently implemented in DSP form in software and can be implemented in software form in a microprocessor based computer. The invention can also be implemented in hardware in various levels of integration. For example, a programmable graphic equalizer or several programmable amplifiers and programmable filters can be used instead. The invention can be used to create any desired tone stack, not just to simulate existing tone stacks. That is, one can create new tone stacks directly from digital data without having to build and test an analog tone control.

What is claimed as the invention is:

1. A circuit for simulating one of a plurality of different tone stacks in an amplifier for an electric guitar, said circuit comprising:

a first filter circuit having programmable gain and frequency response;

a second filter circuit having programmable gain and frequency response;

a data memory storing a plurality of coefficients for controlling said first filter circuit and said second filter circuit;

wherein the first filter circuit and the second filter circuit are interconnected to produce the frequency response of a tone stack having adjustable bass, mid-range, and treble ranges.

2. The circuit as set forth in claim 1 and further including:

a first difference circuit coupled to said first filter and to said second filter;

said first difference circuit producing mid-range signals.

3. The circuit as set forth in claim 2 and further including an amplifier, wherein said mid-range signals are coupled to said amplifier.

4. The circuit as set forth in claim 3 wherein said amplifier has programmable gain.

5. The circuit as set forth in claim 1 and further including:

a first difference circuit coupled to said first filter and to said second filter;

said first difference circuit producing bass signals.

6. The circuit as set forth in claim 5 and further including an amplifier, wherein said bass signals are coupled to said amplifier.

7. The circuit as set forth in claim 1 and further including:

a first difference circuit coupled to said first filter and to said second filter;

said first difference circuit producing treble signals.

8. The circuit as set forth in claim 7 and further including an amplifier, wherein said treble signals are coupled to said amplifier.

9. method for simulating a tone stack in an amplifier including tone controls, said method comprising the steps of:

(a) measuring the gain at bass, mid-range, and treble of the tone stack and recording the results as digital data;

(b) measuring the cut-off frequency between bass and mid-range and between mid-range and treble and recording the results as additional digital data;

(c) repeating steps (a) and (b) at a plurality of settings of the tone stack;

(d) interpolating the data for a tone stack to produce digital coefficients;

(e) applying the digital coefficients to a digital signal processing device to effect simulation the tone stack.

10. The method as set forth in claim 9 wherein step (d) includes the steps of:

(i) reading the settings of the tone controls;

(ii) converting the settings to digital values;

(iii) interpolating the digital data in accordance with the digital values.

11. The method as set forth in claim 9 wherein step (c) includes the step of:

(c) repeating each of steps (a) and (b) for at least five different settings of the tone stack.

12. A tone control circuit comprising:

a first filter circuit having an output and an input;

a second filter circuit having an output and an input;

a first amplifier;

a second amplifier;

a third amplifier;

wherein the cut-off frequencies of the first filter circuit and the second filter circuit are programmable and the gains of the first amplifier, the second amplifier, and the third amplifier are programmable; and wherein the first filter circuit and the second filter circuit are interconnected to produce bass, mid-range, and treble signals that are coupled one each to an amplifier.

13. The tone control circuit as set forth in claim 12 and further including:

an input terminal for receiving an unfiltered signal, said input terminal being coupled to the input of said first filter circuit;

a first difference circuit coupled to the input and the output of said first filter circuit for subtracting a filtered signal from said first filter circuit from the input signal to produce a first difference signal.

14. The tone control circuit as set forth in claim 13 wherein the output of the first filter circuit is coupled to the input of the second filter circuit and further including:

a second difference circuit coupled to the input and the output of said second filter circuit;

said second difference circuit subtracting a filtered signal from said second filter circuit from a filtered signal from said first filter circuit to produce a second difference signal.

15. The tone control circuit as set forth in claim 14 wherein said first difference signal is coupled to said first amplifier and said second difference signal is coupled to said second amplifier.

16. The tone control circuit as set forth in claim 14 wherein the output of the second filter circuit is coupled to the third amplifier.

17. The tone control circuit as set forth in claim 12 wherein said first amplifier, said second amplifier, and said third amplifier have programmable gain controls.

18. The tone control circuit as set forth in claim 17 wherein said first filter circuit and said second filter circuit each have a programmable cut-off frequency.

* * * * *